US005851158A

United States Patent [19]

Winrow et al.

[11] Patent Number: 5,851,158

[45] Date of Patent: Dec. 22, 1998

[54] COATING FOR SPORTS IMPLEMENTS

[76] Inventors: Thomas L. Winrow, 35 LaCanosa Blvd., Santa Rosa Beach, Fla. 32459; Martin E. Lohrman, 58072 Diener Dr., Goshen, Ind. 46526; James B.C. Wu, 11450 Patty Ann Dr., St. Louis, Mo. 63146

[21] Appl. No.: 833,038

[22] Filed: Apr. 3, 1997

[51] Int. Cl.[6] ..... A63B 53/04

[52] U.S. Cl. ..... 473/330

[58] Field of Search ..... 473/324, 325, 473/329, 330, 331, 342, 349; 427/421, 422

[56] References Cited

U.S. PATENT DOCUMENTS

| | | | |
|---|---|---|---|
| 2,763,569 | 9/1956 | Bradstreet | 427/314 |
| 2,908,502 | 10/1959 | Bradstreet | 473/330 |
| 3,989,861 | 11/1976 | Rasmussen | 427/180 |
| 4,342,551 | 8/1982 | Browning | 431/10 |
| 4,343,605 | 8/1982 | Browning | 431/8 |
| 4,416,421 | 11/1983 | Browning | 239/79 |
| 4,768,787 | 9/1988 | Shira . | |
| 4,793,616 | 12/1988 | Fernandez . | |
| 4,917,384 | 4/1990 | Caiati | 473/330 |
| 4,951,953 | 8/1990 | Kim . | |
| 5,029,865 | 7/1991 | Kim | 473/330 |
| 5,207,427 | 5/1993 | Saeki . | |
| 5,242,168 | 9/1993 | Aizawa . | |
| 5,458,334 | 10/1995 | Sheldon et al. . | |
| 5,472,202 | 12/1995 | Yamanaka . | |
| 5,531,444 | 7/1996 | Buettner | 473/349 |
| 5,535,838 | 7/1996 | Keshavan et al. | 427/422 |

FOREIGN PATENT DOCUMENTS

| | | |
|---|---|---|
| 268181 | 7/1965 | Australia . |
| 60-86260 | 5/1985 | Japan . |
| 8-52243 | 2/1996 | Japan . |

*Primary Examiner*—Steven B. Wong
*Attorney, Agent, or Firm*—Aquilino & Welsh

[57] ABSTRACT

A method for coating sports implements to improve the hardness and wear characteristics of the sports implement is disclosed. The method includes the steps of generating a high velocity gas stream directed at a sports implement and feeding a powder within the gas stream such that the powder contacts the sports implement to form a coating with high bond strength. Sports implements coated in accordance with the present method are also disclosed.

5 Claims, 3 Drawing Sheets

COATING FOR SPORTS IMPLEMENTS

BACKGROUND OF THE INVENTION

1. Field of the Invention

The invention relates to coatings for golf club heads. More particularly, the invention relates coatings for sport implements, wherein the coating is applied using a high velocity thermal spray process.

2. Description of the Prior Art

The hardness of the striking surface of a golf club head is directly related to the distance a struck ball will travel and the flight characteristics of the struck golf ball. As such, many attempts have been made to control the striking characteristics of a golf club head by employing a variety of materials.

For example, entire golf club heads have been manufactured from variety of materials, such as, wood, stainless steel, aluminum, graphite and titanium. In additional, striking surface inserts of hard materials have also been developed to increase the hardness of the striking surface. Coatings having also been applied to golf club heads in an attempt to increase the hardness of the striking surface of the golf club head.

However, many of these golf club heads are very expensive to manufacture. In addition, the traditional coating methods often result in low bond strength causing spalling of the coating during the normal use of the golf clubs. Some of the methods require subjecting the club heads to high temperatures which may alter the properties of the club head material. There are also methods to provide a hard coating on a golf club head, but these methods provide coatings where the thickness of the coating is too thin (less than 0.001") to fully take advantage of the hard coating. The methods disclosed in the prior art are also limited to specific coating materials, and provide very limited versatility to club manufacture.

A need, therefore, exists for a method of manufacturing golf club heads, and other sports implements, with a hard, wear resistant layer. The present invention provides such a method.

SUMMARY OF THE INVENTION

It is, therefore, an object of the present invention to provide a method for coating sports implements to improve the hardness and wear characteristics of the sports implement. The method includes the steps of generating a high velocity gas stream directed at a sports implement and feeding a powder within the gas stream such that the powder contacts the sports implement to form a coating with high bond strength.

It is also an object of the present invention to provide a method for coating a sports implement wherein the high velocity gas stream propels the powder at the sports implement at supersonic speed.

It is a further object of the present invention to provide a method for coating a sports implement wherein the powder is chosen from the group consisting of carbides, borides, nitrides, and oxides.

It is also an object of the present invention to provide a method for coating a sports implement including the additional step of feeding a second powder within the gas stream such that the second powder contacts the sports implement, forming a coating composed of the powder and the second powder with high bond strength.

It is another object of the present invention to provide a method for coating a sports implement wherein the high velocity gas stream is generated by the combustion of a fuel.

It is also an object of the present invention to provide a method for coating a sports implement wherein the combustion is generated by mixing oxygen with a fuel chosen from the group consisting of propylene, hydrogen and kerosene.

It is a further object of the present invention to provide a method for coating a sports implement wherein the sports implement is chosen from the group consisting of a golf club head, a golf club shaft, a blade of a hockey skate, a skateboard, a roller of an in-line skate, a roller of a roller skate, a baseball bat and a tennis racket.

It is also an object of the present invention to provide a method for coating a golf club head in the manner described above including the additional step of feeding a second powder within the gas stream such that the second powder contacts the golf club head, forming a coating composed of the powder and the second powder with high bond strength, wherein the powder and the second powder are chosen to optimize the striking characteristics of the golf club head.

It is another object of the present invention to provide a method for coating a golf club head in the manner described above including the additional step of applying multiple coating layers to the golf club head to vary the loft characteristics of the golf club head.

It is a further object of the present invention to provide a golf club head having an improved surface. The golf club head includes a coating formed by a powder applied to the golf club head by a high velocity thermal spray process.

It is another object of the present invention to provide a golf club head wherein the powder is chosen from the group consisting of carbides, borides, nitrides, and oxides.

It is a further object of the present invention to provide a golf club head wherein the coating improves the hardness characteristics of the golf club head.

It is also an object of the present invention to provide a golf club head wherein the coating is applied to a forward striking surface of the golf club head to bring the weight of the golf club head forward.

It is also an object of the present invention to provide a golf club head including a second powder applied to the surface of the golf club head, forming a coating composed of the powder and the second powder with high bond strength, wherein the powder and the second powder are chosen to optimize the striking characteristics of the golf club head.

It is a further object of the present invention to provide a golf club head wherein the golf club head includes multiple coating layers which vary the loft characteristics of the golf club head.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
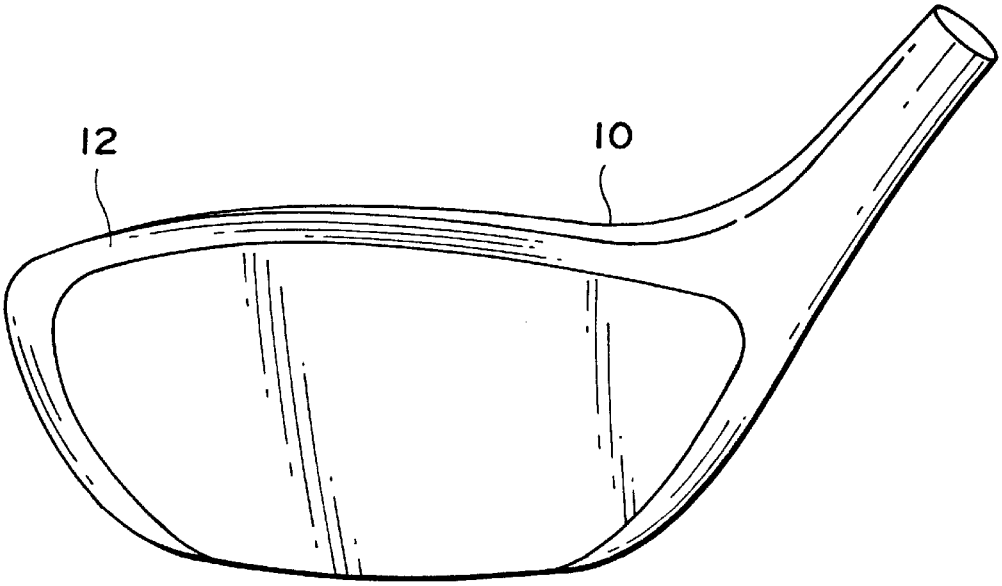
FIG. 1 is a perspective of a golf club head coated in accordance with the present invention.
Figure 3:
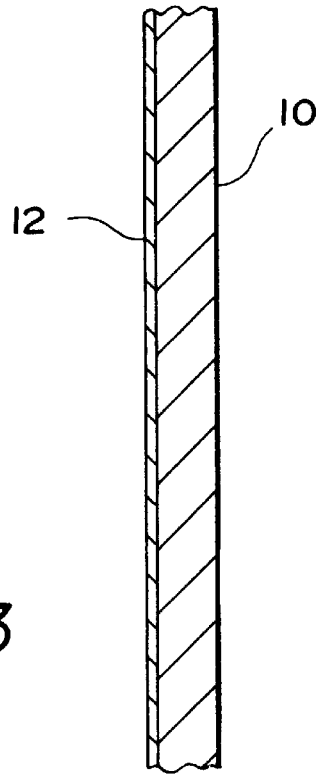
FIG. 3 is a cross sectional view of a golf club head made in accordance with the present invention.
Figure 2:
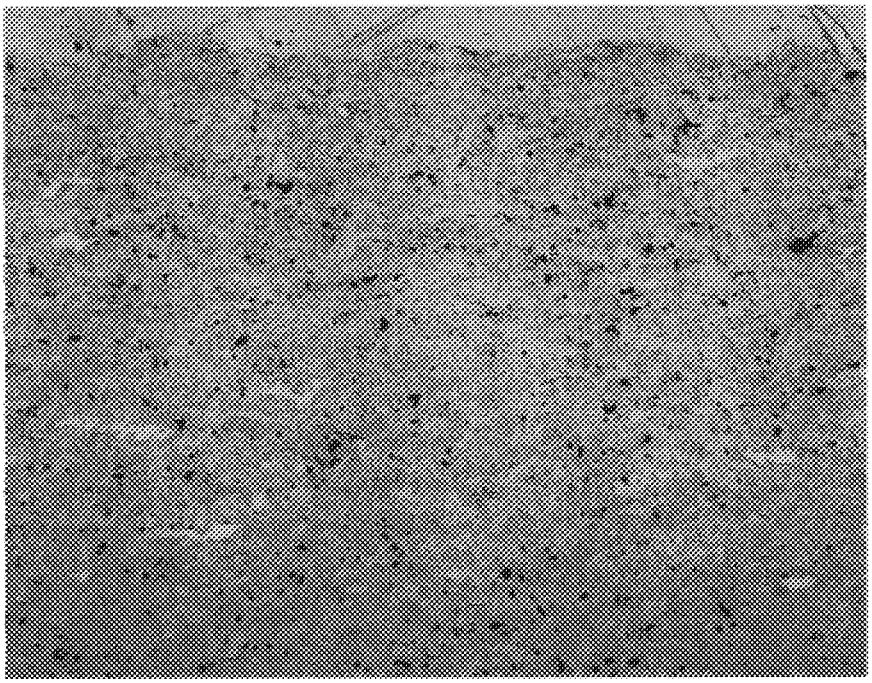
FIG. 2 is photograph of a club head coated in accordance with the present invention.

With reference to FIGS. 1 through 3, a golf club head 10 formed in accordance with the present method is disclosed. The golf club head 10 includes a coating 12 of a wear resistant material. In accordance with the preferred embodiment of the invention, the material may be tungsten carbide, chromium carbide in a matrix of cobalt or its alloys, or chromium carbide in a matrix of nickel or its alloys. In addition, the coating may be composed of borides, nitrides, oxides, and other carbides. Further, monolithic cobalt based alloys and nickel based alloys can also be sprayed on the golf club head to achieve the desired coating properties. While a variety of materials are disclosed above, other materials could be employed in accordance with the present invention without departing from the spirit of the present invention.

The coating 12 may be applied to the club head at any point in the manufacturing process. As such, the coating 12 may be applied to the raw club head before any finishing has taken place, or the coating 12 may be applied at anytime thereafter. The head weight may, therefore, be generated before the finish is applied. In contrast, the application of the coating may be employed to pinpoint and control the weight distribution about the club head 10; that is, the coating 12 may be applied in such a way to alter the club head's center of gravity or to move the balance point of the club head. Similarly, the coating 12 may be applied during the manufacture process to control, or maintain, an axis system needed to balance the club head and the shaft.

In addition to altering the weighting of a golf club head, the present coating process may be employed to slightly vary the loft characteristics of a club head. This is accomplished by the specifically layering the coating on the club to adjust the launch angle and face progression for ball flight control. As one of ordinary skill in the art will certainly appreciate, each layer of coating material is very thin (for example, approximately 0.001" to 0.005") and multiple layers may be strategically employed on the striking surface of the golf club head to vary the loft characteristics of the golf club head under very controlled tolerances. For example, additional layers may be applied at the top of the striking surface or the bottom of the striking surface in a tapered manner to vary the loft characteristics of the golf club head.

As stated above, a variety of materials may be employed in accordance with the present invention. It is contemplated that these materials may be used alone, or in combination, to change the feel of the golf club head 10 as a golf ball is struck by the golfer. For example, the various materials discussed above may be employed to control the surface texture, hardness, shape, shape of a golf shot, deflection of the golf ball when leaving the club face, and the spin rotation of the golf ball on leaving the face of the club. The materials may be employed to provide the club head with a harder or softer feel, by spraying different materials on the different types of metals used in the making of golf club heads.

Figure 4:
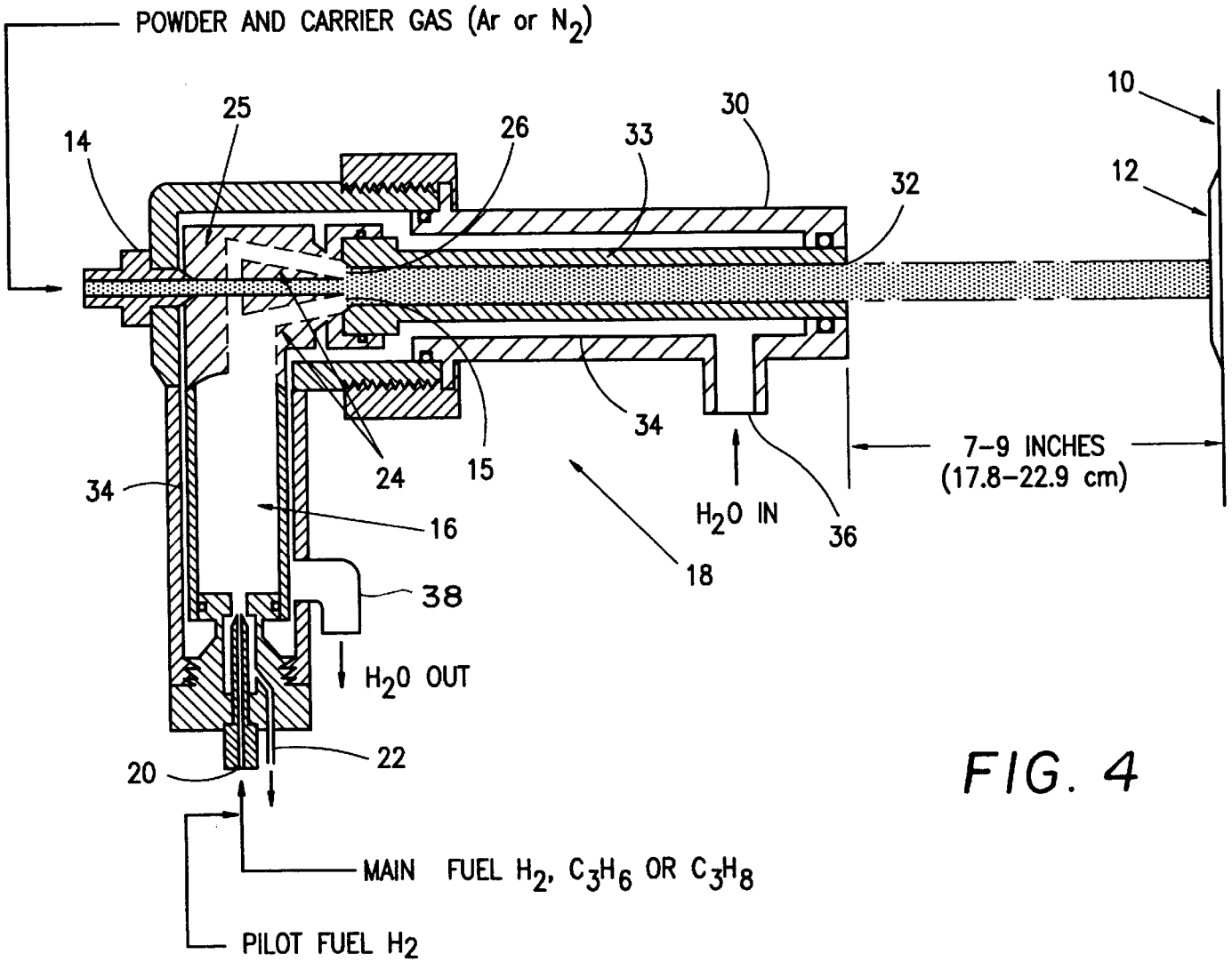
FIG. 4 is a schematic of the coating process, including the spray gun, powder, golf club head, and coating.

With reference to FIG. 4, the coating 12 is applied in powder form by utilizing a high velocity thermal spray process. While the spray process is disclosed below in some detail, the spray process and apparatus are disclosed in detail in U.S. Pat. No. 4,416,421, to Browning, which is incorporated herein by reference.

Briefly, the coating material 14 is applied to the surface of the golf club head 10 at supersonic speeds, typically over approximately 1800 feet per minute. A high velocity gas stream 15 is generated by the combustion of a fuel, such as, propylene, hydrogen or kerosene, and oxygen in the combustion chamber 16 of a spray gun 18. Specifically, the primary fuel, that is, propylene, hydrogen, or kerosene is fed into the combustion chamber 16 through a first inlet 20, while the oxygen is fed into the combustion chamber 16 through a second inlet 22.

The combustion within the combustion chamber 16 creates a high velocity gas stream 15 at the combustion ports 24 (while only two ports are shown in FIG. 4, the preferred spray gun 18 includes four ports) adjacent the combustion head 25. The powder coating material 14 is then fed into the high velocity gas stream 15 through a third inlet 26 having a outlet end 28 located adjacent the combustion ports 24. The powder coating material 14 is carried by an argon (Ar) or nitrogen ($N_2$) carrier gas.

As the powder and carrier gas exit the third inlet 26, they are carried by the high velocity gas stream 15 through the nozzle 30 of the spray gun 18 and out the outlet 32 of the spray gun 18. The nozzle 30 of the spray gun 18 is provided with a copper nozzle insert 33 through which the powder coating material 14, gas carrier and the high velocity gas stream 15 pass. The high velocity gas stream 15 creates heat which is dissipated by the provision of a cooling jacket 34 within the spray gun 18. The cooling jacket 34 surrounds the copper nozzle insert 32 and the combustion chamber 16, creating a cavity through which water is passed as the spray gun 18 is employed. The water enters the cooling jacket 34 through a water inlet 36 at the distal end 38 of the nozzle 30 of the spray gun 18 and exits the spray gun 18 through a water outlet 38 located adjacent the combustion chamber 16 of the spray gun 18.

The powder coating material 14 exiting the spray gun 18 is directed to the surface of the golf club head 10 to be coated. As the powder coating material 14 leaves the outlet 32 of the spray gun 18 at a high speed, the powder 14 partially melts. The particles of the partially melted powder 14 then impinge on the surface of the golf club head 10. The particles are flattened upon impact with the surface of the golf club head 10. The numerous, partially molten, flattened particles of the powder 14 subsequently solidify and build up on the surface, forming a coating of high integrity. Coatings applied in accordance with this process generally have a bond strength of greater than 10,000 psi, and the coating will, therefore, not spall in the normal use of the club.

Golf club heads coated in this manner exhibit exceptional hardness characteristics based upon the powder coating material applied to the surface of the golf club head. For example, a golf club head coated with Stelcar®JK®117, a tungsten carbide/cobalt powder, in accordance with the present invention exhibits a microhardness of approximately 932–1243 DPH300 g and a macrohardness of approximately 89.6–94.3 15N. The hardness characteristics are desirable for a variety of reasons. First, hardness on the striking surface of the golf club head minimizes the loss of kinetic energy transferred from the golf club head to the ball during impact, resulting in longer distance. In addition, a hard surface applied to the entire golf club head provides a golf club head which is more wear resistance, and less likely to be damaged by the bangs and bumps a golf club head is exposed to during normal usage. The coating is especially advantageous for club heads made of softer metals, such as titanium and aluminum.

By coating the face, that is, the striking surface, of the club head as disclosed above, the weight of the club head is brought forward. This changes the shaft deflection, and ultimately changes the ball flight characteristics apart from the weighting process of the club head. By bringing additional weight to the face of the club head, the shaft deflection will change as the amount of weight on the club head's face is increased. The more weight that is brought forward on the club head, the greater is the tendency to square the club face at impact.

While specific materials have been disclosed for use in coating a golf club, a wide variety of coating materials may be employed to suit the specific needs of a golfer. For example, coatings of differing hardness characteristics may be employed to suit both novice golfers and expert golfers.

In addition, the durability and hardness of the coating generated by the present process may be employed in a variety of commonly used sports implements, without departing from the spirit of the present invention. For example, the coating may be applied to hockey skate blades. The hardness of the coating creates a barrier protecting the blade edges from wear, and limiting the frequency at which the blades must be sharpened. The coating may also be employed in golf club shafts, skateboards, the rollers of in-line skates and roller skates, baseball bats, tennis rackets, etc.

While the preferred embodiments have been shown and described, it will be understood that there is no intent to limit the invention by such disclosure, but rather, is intended to cover all modifications and alternate constructions falling within the spirit and scope of the invention as defined in the appended claims.

We claim:

1. A golf club head having a surface which improves the hardness, striking and wear characteristics of the golf club head, comprising:

a golf club head having a coating of approximately 0.001" to 0.005" per layer formed by a powder applied to the golf club head by a high velocity thermal spray process; and wherein the powder is chosen from the group consisting of carbides, borides, nitrides, and oxides, and the powder is applied at a speed over approximately 1800 feet per minute to form a coating with high bond strength.

2. The golf club head according to claim 1, including a second powder applied to the surface of the golf club head, forming a coating composed of the powder and the second powder with high bond strength, wherein the powder and the second powder are chosen to optimize the striking characteristics of the golf club head.

3. The golf club head according to claim 1, wherein the golf club head includes multiple coating layers which vary the loft characteristics of the golf club head.

4. The golf club head according to claim 1, wherein the coating improves the hardness characteristics of the golf club head.

5. The golf club head according to claim 1, wherein the coating is applied to a forward striking surface of the golf club head to bring the weight of the golf club head forward.

* * * * *

UNITED STATES PATENT AND TRADEMARK OFFICE

CERTIFICATE OF CORRECTION

PATENT : 5,851,158

DATED : December 22, 1998

INVENTOR(S) : Thomas L. Winrow et al

It is certified that error appears in the above-identified patent and that said Letters Patent is hereby corrected as shown below:

On the title page, item [76] Inventors: please add "David A. Lee, Ligonier, IN".

Signed and Sealed this

Eighteenth Day of May, 1999

*Attest:*

Q. TODD DICKINSON

*Attesting Officer*

*Acting Commissioner of Patents and Trademarks*